United States Patent [19]

Vandevier et al.

[11] 4,211,625

[45] Jul. 8, 1980

[54] IMPRESSED CURRENT CATHODIC PROTECTION SYSTEM FOR SUBMERSIBLE DOWNHOLE PUMPING ASSEMBLY

[75] Inventors: Joseph E. Vandevier, Broken Arrow; Larry E. Hocutt, Tulsa, both of Okla.

[73] Assignee: Borg-Warner Corporation, Chicago, Ill.

[21] Appl. No.: 941,629

[22] Filed: Sep. 11, 1978

[51] Int. Cl.[2] ..... C23F 13/00

[52] U.S. Cl. ..... 204/197; 204/196

[58] Field of Search ..... 204/147, 196, 148, 197

[56] References Cited

U.S. PATENT DOCUMENTS

| | | | |
|---|---|---|---|
| 1,608,709 | 11/1926 | Mills | 204/197 |
| 2,276,714 | 3/1942 | Brown | 204/196 |
| 2,481,222 | 9/1949 | Jones . | |
| 2,723,340 | 11/1955 | Boggs et al. | 219/38 |
| 2,875,142 | 2/1959 | Landers et al. | 204/196 |
| 2,944,603 | 7/1960 | Baker et al. | 166/65 |
| 3,020,216 | 2/1962 | Bradley | 204/23 |
| 3,056,738 | 10/1962 | Fischer | 204/196 |
| 3,081,251 | 3/1963 | Spector | 204/196 |
| 3,166,487 | 1/1965 | Owren | 204/197 |
| 3,340,500 | 9/1967 | Boyd et al. | 324/1 |
| 3,405,283 | 10/1968 | Leonard | 307/95 |
| 3,458,643 | 7/1969 | Dorr | 204/196 |
| 3,725,669 | 4/1973 | Tatum | 204/196 |
| 3,769,521 | 10/1973 | Caldwell et al. | 204/196 |

*Primary Examiner*—G. L. Kaplan

*Attorney, Agent, or Firm*—James E. Tracy

[57] ABSTRACT

Cathodic protection of a deep well submersible pumping assembly against the corrosive effect of electrolysis is achieved by providing a DC voltage source at the downhole pumping assembly, the negative terminal of the source being electrically connected to the metal surfaces which are in contact with the well fluid while the source's positive terminal is electrically connected to a sacrificial anode submerged in the well fluid. Current flows from the anode to the metal surfaces to reverse the process of electron flow caused by the electrolytic corrosion, thereby inhibiting the corrosion process on the metal surfaces. In effect, the corrosion is transferred to the sacrificial anode.

1 Claim, 4 Drawing Figures

IMPRESSED CURRENT CATHODIC PROTECTION SYSTEM FOR SUBMERSIBLE DOWNHOLE PUMPING ASSEMBLY

BACKGROUND OF THE INVENTION

This invention relates to an impressed current cathodic protection system for obtaining anti-electrolysis action at deep well submersible pumping equipment to counter the effects of electrolytic corrosion.

In pumping fluid from a deep well, such as an oil well, a conventional practice is to position a pumping assembly (usually including an electric motor, a pump driven by the motor, and a seal section) in the well near the bottom thereof. Electrical energy is supplied from the surface to the downhole pumping assembly via a power cable and the pumped fluid is conveyed from the well to the surface by means of tubing. Customarily, the motor is positioned below the pump, with the seal section effectively interfacing the two. The entire pumping assembly will therefore normally be immersed in the well fluid. The seal section retains within the motor a fluid which serves both as a lubricant and as a coolant for the moving parts of the motor. The seal section also prevents the well fluid from entering the motor, while at the same time balancing interval submergence pressures. In addition, the seal section carries the thrust of the pump during operation.

Unfortunately, the fluid in a deep well may include components that will corrode the metal surfaces of the pumping assembly that are in contact with the well fluid. Usually, this would include the external surfaces of the metal housings in which the pump, motor and seal sections are encased, plus the internal surfaces of the pump. Examples of corrosive components in the well fluid are brine and dissolved carbon dioxide. Such components will attack and corrode any metal surface. The corrosion is caused by electrolytic action, the corrosive solution constituting an electrolyte through which electrons flow toward the metal surfaces.

The present invention overcomes the electrolytic corrosion problem, which plagues downhole pumping equipment, by effectively reversing the electrolysis process so that electrons will flow away from the metal surfaces to be protected. This is achieved by making the metal surfaces cathodic with respect to an anode and impressing current flow from the anode to the cathodic elements. Of course, current flow and electron flow are in opposite directions. Current flows from anode to cathode, while electrons flow from cathode to anode.

SUMMARY OF THE INVENTION

The invention provides an impressed current cathodic protection system for a deep well submersible downhole pumping assembly which has a pump, a seal section and a motor each of which is encased in a respective one of three metal housings in contact with the fluid in the well. The protection system comprises a DC supply means, mounted to the downhole pumping assembly, for providing a source of DC voltage having positive and negative terminals. There are means for electrically connecting the negative terminal of the DC voltage source to the three metal housings in which the pump, seal section and motor are encased. A sacrificial anode is mounted to the downhole pumping assembly and means are included for electrically connecting the positive terminal of the DC voltage source to the sacrificial anode. With this arrangement, current will flow from the anode and through the well fluid to the three metal housings to protect the housings against corrosion.

DESCRIPTION OF THE DRAWINGS

The features of the invention which are believed to be novel are set forth with particularity in the appended claims. The invention, together with further advantages and features thereof, may best be understood, however, by reference to the following description in conjunction with the accompanying drawings in which like reference numbers identify like elements, and in which:

DESCRIPTION OF THE ILLUSTRATED EMBODIMENTS

Figure 1:
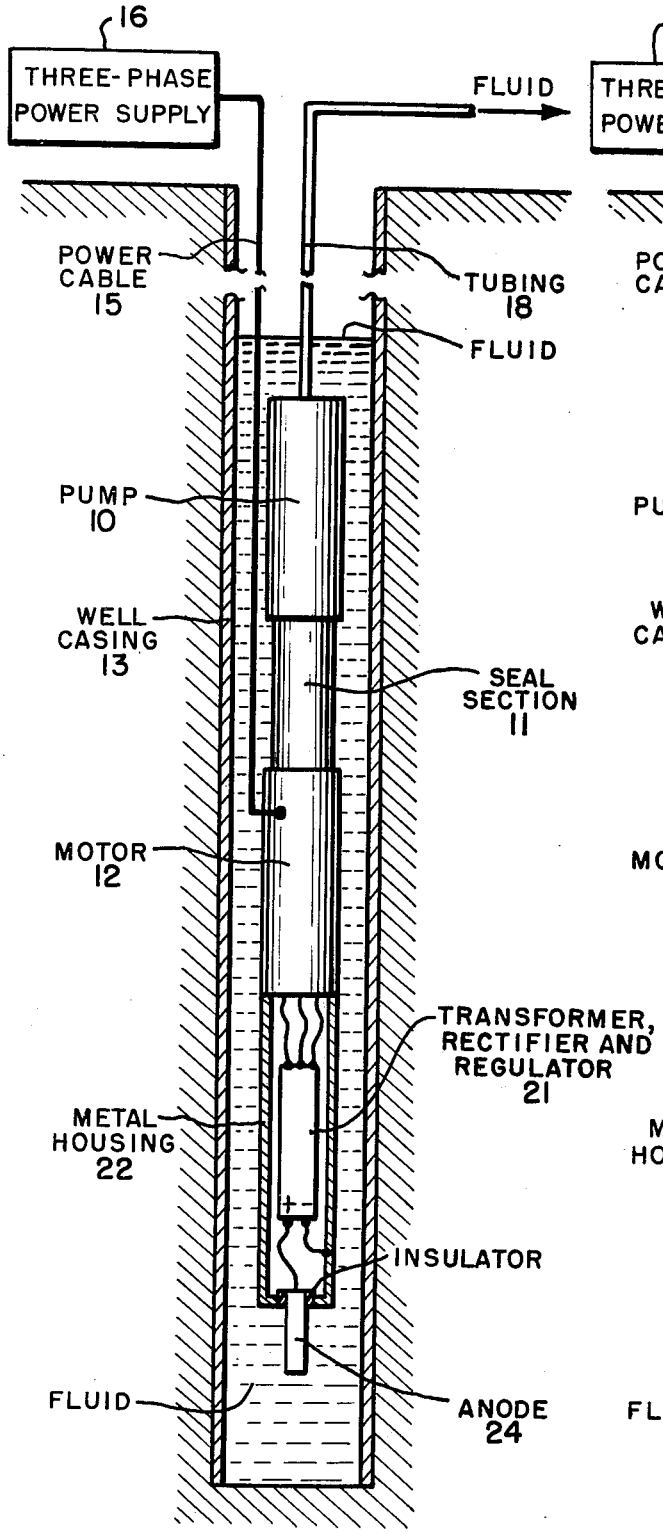
FIG. 1 schematically illustrates, partially in section, a submersible oil pumping assembly installed downhole in a deep well bore and having an impressed current cathodic protection system constructed in accordance with one embodiment of the invention.

Consideration will initially be given to the embodiment of FIG. 1. The pumping assembly comprising the axially aligned pump 10, seal section 11 and motor 12 is of conventional construction and is positioned in the well casing 13 which is a metal tube surrounded by cement. Motor 12 is energized, over a three-conductor power cable 15, by a three-phase power supply 16 located at the surface above the well. When three-phase AC voltage is applied to motor 12, the motor shaft rotates and drives a shaft passing through seal section 11 which in turn drives the shaft of pump 10. The well fluid from the bottom of the oil well is thereupon pumped upwardly through tubing 18 for discharge at the surface. Each of the three components of the pumping assembly is contained within a metal housing and the outside surfaces of these three housings, as well as the internal surfaces of pump 10, are exposed to the corrosive well fluid. The electrolytic corrosion, which ordinarily would occur on all of the metal surfaces, is effectively neutralized in the FIG. 1 embodiment by causing DC current to flow to those metal surfaces, the electrons therefore flowing away from the surfaces to reverse the electrolysis process otherwise taking place.

In short, a DC supply means and a sacrificial anode are provided at the downhole location in order to produce the required current flow to the metal surfaces to be protected. More particularly, the DC supply means is designated by the reference numeral 21 and is mounted within a tubular shaped metal housing 22 which in turn is attached to the pumping assembly. Specifically, housing 22 may be bolted to the lower end of motor 12, the four metal housings thereby being electrically interconnected. In the FIG. 1 embodiment, the required DC is produced by rectifying AC voltages derived from the motor windings. Circuit 21 therefore includes a three-phase transformer, having its three primary windings connected to the three windings of motor 12, and a three-phase rectifier for rectifying the AC voltages developed at the transformer secondary windings. Preferably, DC supply means 21 would also include a regulator for establishing and maintaining a desired DC voltage level at the output terminals labelled "+" and "−" in FIG. 1. Those terminals therefore constitute and may be considered a source of DC voltage.

The sacrificial anode, referenced by the numeral 24, is mounted to, but insulated from, the lower end of metal housing 22. Anode 24 may be made of a variety of suitable materials. For example, it may be constructed of aluminum. The negative terminal of the DC voltage source is electrically connected to housing 22, and consequently to the three housings in which pump 10, seal section 11 and motor 12 are encased. In addition, the negative terminal will be electrically connected within pump 10 to the pump's internal surfaces that are in contact with the well fluid. The sacrificial anode 24 is electrically connected to the positive terminal of the DC voltage source provided by circuit 21.

With this arrangement, the DC voltage will be of appropriate magnitude to produce current flow from anode 24 and through the electrolytic well fluid to the outside surfaces of the four metal housings and to the inside surfaces of pump 10, thereby causing electrons to flow away from those surfaces to prevent corrosion of those surfaces. In effect, the corrosion is transferred from the metal surfaces to the sacrificial anode which may be sized so that it will be effective as long as the oil well is to be operating.

Figure 2:
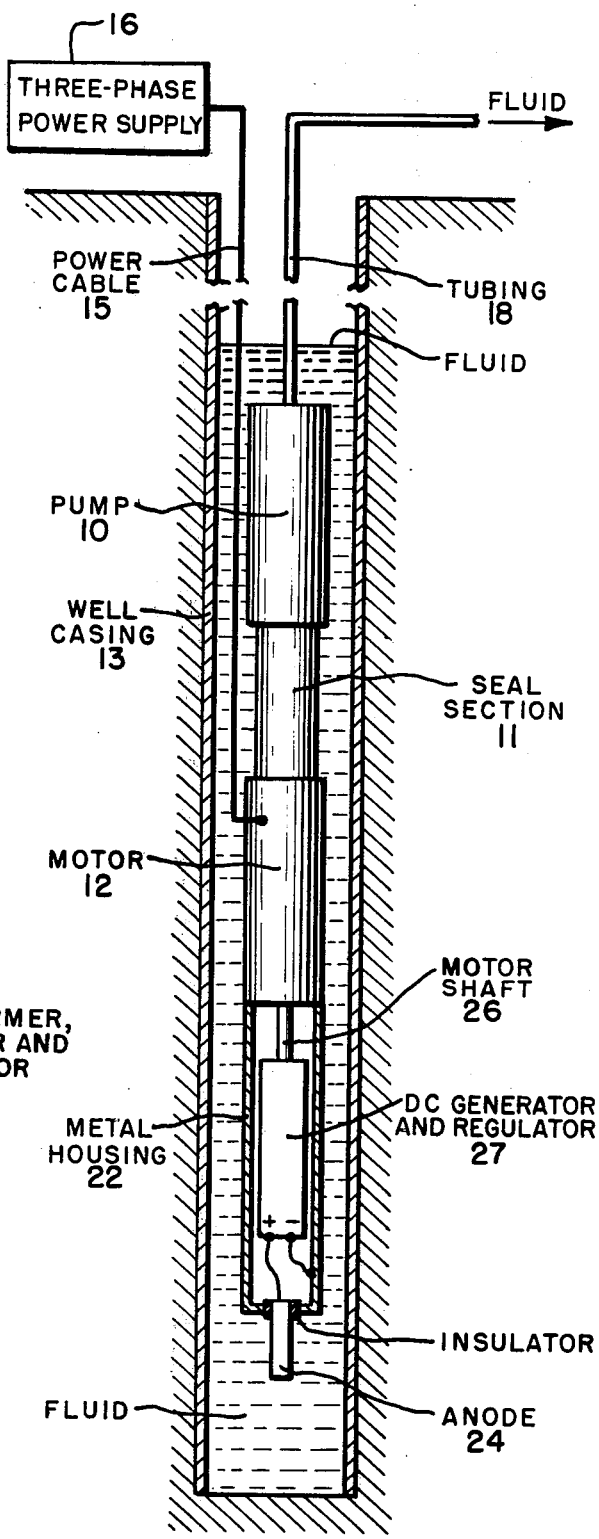
FIGS. 2, 3 and 4 are somewhat similar to FIG. 1 and illustrate deep well submersible pumping assemblies having cathodic protection systems constructed in accordance with three other embodiments of the invention.

Turning now to the embodiment of FIG. 2, the necessary downhole DC voltage source is provided by employing the motor shaft 26 to drive a DC generator. Element 27, which constitutes the DC supply means in FIG. 2, therefore includes the DC generator and a regulator for maintaining the required DC voltage level across the positive and negative output terminals.

Figure 3:
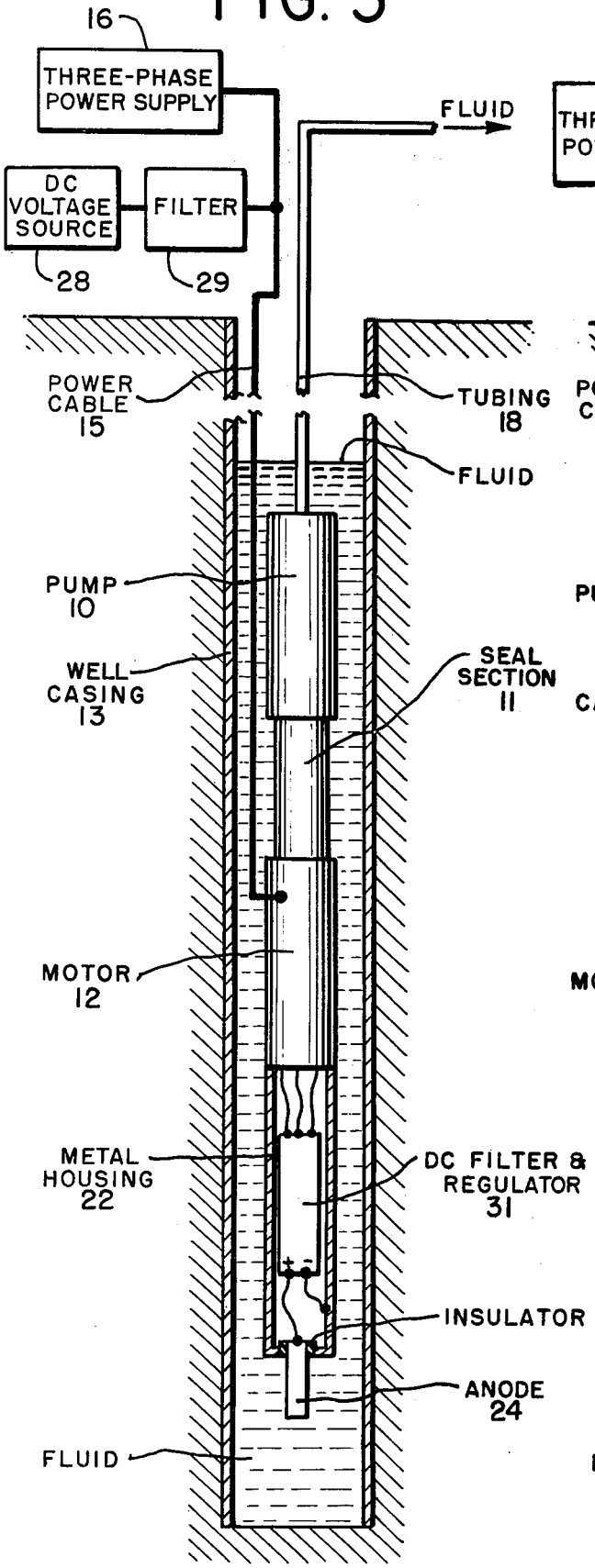

In the FIG. 3 embodiment, the DC voltage is provided at the location of the downhole pumping equipment by conveying that DC voltage from the surface location via the three-conductor power cable. This is accomplished in FIG. 3 by employing DC voltage source 28 and filter 29 above the well for super-imposing a DC voltage on the three-phase AC voltage which is applied to motor 12. Circuit 31, which provides the downhole DC supply means in FIG. 3, couples to the motor windings and includes a DC filter for separating the DC voltage component from the AC voltage. Preferably, a regulator would also be included in DC supply means 31 to ensure that the DC output voltage across the + and − terminals will have a constant desired magnitude. One arrangement for superimposing a DC voltage on a three-phase AC voltage for delivery to a downhole pumping location is disclosed in U.S. Pat. No. 3,340,500, issued Sept. 5, 1967, in the name of Clinton A. Boyd et al. In that patent, a network of three Y-connected balanced inductance coils is connected, at the surface location, to the three conductors in the power cable, and a DC voltage is applied between the center or neutral point of the network and earth ground. Downhole, the DC voltage may be recovered between earth ground and the neutral point of another network of three Y-connected balanced coils connected to the three power conductors.

Figure 4:
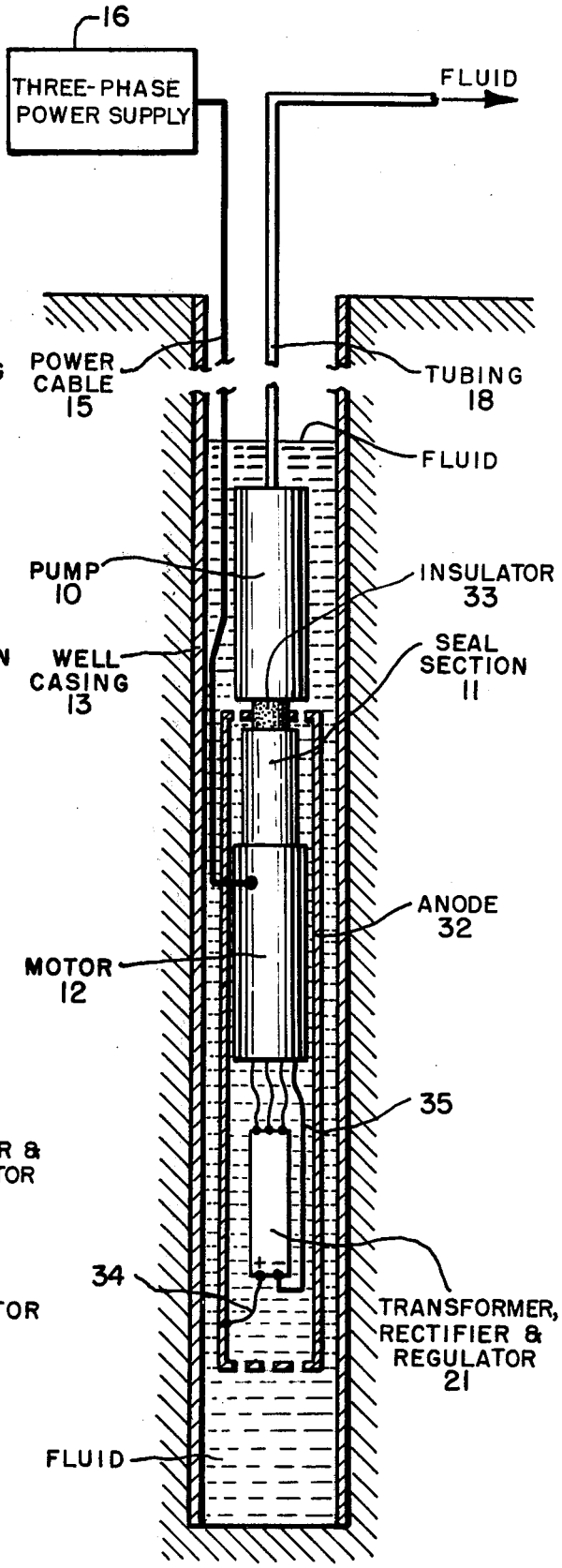

Of course, the sacrificial anode can take any of a variety of different shapes and configurations. As shown in the embodiment of FIG. 4, anode 32 is tubular shaped and encompasses the seal section and the motor. Insulator 33 is included to schematically indicate that anode 32 is electrically isolated from the metal housings. Wire conductor 34 electrically connects the positive terminal of DC supply means 21 to anode 32, while wire conductor 35 schematically shows that the negative terminal is connected to the metal housing of motor 12, which as mentioned is electrically connected to the housings of seal section 11 and pump 10. Anode 32 may be sufficiently porous or have openings therein to permit the well fluid to flow within the anode and over the metal housings of motor 12 and seal section 11. Alternatively, both ends of tubular shaped anode 32 may be open, a spider being used to connect the upper end to insulator 33. Pump 10 would then pull the well fluid between the anode and the housings of seal section 11 and motor 12.

While particular embodiments of the invention have been shown and described, modifications may be made, and it is intended in the appended claims to cover all such modifications as may fall within the true spirit and scope of the invention.

We claim:

1. An impressed current cathodic protection system for a deep well submersible downhole pumping assembly having a pump, a seal section and a three-phase motor each of which is encased in a respective one of three metal housings in contact with the fluid in the well, the pump having internal metal surfaces also in contact with the well fluid, and wherein a three-phase AC power supply, located at the surface above the well, couples to and energizes the three-phase motor in the downhole pumping assembly, said protection system comprising:

DC supply means, mounted below the downhole pumping assembly and having positive and negative terminals, and including a three-phase transformer for coupling the windings of the three-phase motor to a rectifier in order to rectify AC voltages derived from the motor windings to provide a DC voltage across said positive and negative terminals;

means for electrically connecting said negative terminal of said DC supply means to the three metal housings, in which the pump, seal section and motor are encased, and also to the internal metal surfaces of the pump;

a tubular shaped sacrificial anode mounted to said downhole pumping assembly and encompassing and spaced from the seal section and the three-phase motor, said anode being constructed to permit the well fluid to flow within said anode and over the metal housings of the seal section and motor;

and means for electrically connecting said positive terminal of said DC supply means to said sacrificial anode, current thereby flowing from said anode and through the well fluid to the three metal housings and to the internal metal surfaces of the pump to protect the metal housings and metal surfaces against corrosion.

* * * * *